US007318710B2

(12) United States Patent
Lee et al.

(10) Patent No.: US 7,318,710 B2
(45) Date of Patent: Jan. 15, 2008

(54) FIXED SCROLL OF SCROLL COMPRESSOR

(75) Inventors: Byeong-chul Lee, Seoul (KR); Byung-kil Yoo, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 11/213,166

(22) Filed: Aug. 26, 2005

(65) Prior Publication Data

US 2006/0222546 A1 Oct. 5, 2006

(30) Foreign Application Priority Data

Mar. 30, 2005 (KR) ..... 10-2005-0026598

(51) Int. Cl.
*F04C 18/00* (2006.01)

(52) U.S. Cl. ..... 418/55.2; 418/55.1

(58) Field of Classification Search ..... 418/55.2, 418/55.1

See application file for complete search history.

(56) References Cited

U.S. PATENT DOCUMENTS

| | | | | |
|---|---|---|---|---|
| 4,609,334 | A * | 9/1986 | Muir et al. | 418/55.2 |
| 4,767,293 | A * | 8/1988 | Caillat et al. | 418/55.3 |
| 4,815,951 | A * | 3/1989 | Kakuda et al. | 418/15 |
| 5,127,809 | A * | 7/1992 | Amata et al. | 418/55.2 |
| 5,342,184 | A * | 8/1994 | Comparin et al. | 418/55.2 |
| 5,582,511 | A * | 12/1996 | Fairbanks | 418/15 |
| 5,735,677 | A * | 4/1998 | Miura et al. | 418/55.2 |
| 6,135,736 | A * | 10/2000 | Tucker et al. | 418/55.2 |
| 6,364,643 | B1 * | 4/2002 | Milliff | 418/15 |
| 6,641,379 | B1 * | 11/2003 | Dewar et al. | 418/55.2 |
| 2001/0006603 | A1 * | 7/2001 | Hong et al. | 418/55.1 |

FOREIGN PATENT DOCUMENTS

| | | | |
|---|---|---|---|
| JP | 11-148470 | | 6/1999 |
| JP | 11-159482 | | 6/1999 |
| JP | 11148470 | A * | 6/1999 |
| JP | 11159482 | A * | 6/1999 |

OTHER PUBLICATIONS

Eugene A. Avallone and Theodore Baumeister III, Marks' Standard Handbook for Mechanical Engineers—10th Edition, Copyright 1996, Publisher: McGraw-Hill, pp. 3.2-3.10.*

* cited by examiner

*Primary Examiner*—Thomas Denion
*Assistant Examiner*—Mary A Davis
(74) *Attorney, Agent, or Firm*—Lee, Hong, Degerman, Kang & Schmadeka

(57) ABSTRACT

Disclosed herein is a fixed scroll of a scroll compressor capable of preventing gaseous refrigerant, that is heated in the compressor or contains a large amount of oil scatted in a compression unit, from being introduced into a compression chamber. The fixed scroll includes an open involuted wrap provided at a lower surface thereof, a compression chamber defined in the wrap, a plurality of mounting legs formed at a lower surface of a flange portion around the wrap, and an interceptive guiding portion configured to guide suctioned gaseous refrigerant, introduced to the lower surface of the flange portion, to a tip end of the wrap while preventing the gaseous refrigerant from being circulated between the mounting legs underneath the lower surface of the flange portion, thereby allowing the refrigerant to be introduced into the compression chamber.

6 Claims, 4 Drawing Sheets

FIXED SCROLL OF SCROLL COMPRESSOR

CROSS REFERENCE TO RELATED APPLICATIONS

Pursuant to 35 U.S.C. § 119(a), this application claims the benefit of earlier filing date and right of priority to Korean Patent Application No. 10-2005-0026598, filed on Mar. 30, 2005, the content of which is hereby incorporated by reference herein in its entirety.

BACKGROUND OF THE INVENTION

1. Field of the Invention

The present invention relates to a scroll compressor, and more particularly, to a fixed scroll of a scroll compressor which is capable of preventing gaseous refrigerant, that is heated in the compressor, from being introduced into a compression chamber.

2. Description of the Related Art

FIG. 1 is a longitudinal sectional view illustrating important parts of a conventional scroll compressor. FIG. 2 is a perspective view illustrating a fixed scroll of FIG. 1. FIG. 3 is a bottom perspective view of the fixed scroll of FIG. 2.

Arrows shown in FIGS. 1 to 3 indicate a flow direction of gaseous refrigerant.

As shown in FIGS. 1 to 3, the conventional scroll compressor includes a shell 100 defining a sealed space therein and provided with a suction pipe 101 and a discharge pipe 102, a compression unit 200 arranged in an upper portion of the shell 100 and adapted to compress gaseous refrigerant, and a crankshaft 300 adapted to drive the compression unit 200 when it is rotated by a drive unit.

The compression unit 200 includes an orbiting scroll 201 arranged on an upper surface of a main frame 400 in the shell 100 while being coupled to an upper end of the crankshaft 300, and a fixed scroll 202 arranged on the upper surface of the main frame 400 to be engaged with the orbiting scroll 201 such that a compression chamber is defined between the scrolls 201 and 202. With this configuration, when the orbiting scroll 201 performs an orbiting motion in accordance with rotation of the crankshaft 300, gaseous refrigerant is introduced into the compression chamber to thereby be compressed therein.

The fixed scroll 202 includes a scroll body 203 provided, at a lower surface thereof, with an open involuted wrap 203*a* to define a compression chamber 203*b* therein. The fixed scroll 202 further includes a flange portion 204 formed along an outer circumference of the scroll body 203, and a plurality of mounting legs 205 formed at a lower surface of the flange portion 204 around the wrap 203*a* to be mounted on the upper surface of the main frame 400.

In the scroll compressor configured as stated above, as the refrigerant, that is introduced into the shell 100 via the suction pipe 101, strikes a suction baffle 401 formed at one side of the main frame 400, part of the gaseous refrigerant is directed upward toward the compression unit 200, and the remaining part of the refrigerant is directed downward to be circulated inside the shell 100.

The part of the gaseous refrigerant, upwardly guided against the suction baffle 401, is circulated between the mounting legs 205 underneath a lower surface of the flange portion 204 to thereby be introduced into the compression chamber 203*b* through a tip end of the wrap 203*a*.

The remaining part of the gaseous refrigerant, downwardly guided against the suction baffle 401, is heated while being circulated inside the shell 100. After that, the heated gaseous refrigerant is directed upward to thereby be circulated between the mounting legs 205 underneath the lower surface of the flange portion 204 as designated by arrows in FIG. 2. In this way, the heated gaseous refrigerant is finally introduced into the compression chamber 203*b* through the tip end of the wrap 203*a*

A problem of the conventional scroll compressor configured as stated above is that suctioned gaseous refrigerant cannot be directly introduced into the compression chamber because it is guided to strikes the lower surface of the flange portion by the suction baffle to thereby be circulated between the mounting legs. Another problem of the conventional scroll compressor is that heated gaseous refrigerant is introduced into the compression chamber through the tip end of the wrap after being circulated between the mounting legs underneath the lower portion of the flange portion. Introduction of the heated gaseous refrigerant considerably degrades the volumetric efficiency of the compressor, resulting in deterioration in the overall performance of the compressor.

In the case of the gaseous refrigerant, which is circulated in the compressor and then is introduced into the compression chamber, furthermore, it contains a large amount of oil that is scattered in a compression unit, resulting in an increase in the amount of oil discharged from the compressor.

SUMMARY OF THE INVENTION

Therefore, the present invention has been made in view of the above problems, and it is an object of the present invention to provide a fixed scroll of a scroll compressor which can prevent gaseous refrigerant, that is heated in the compressor or contains a large amount of oil scattered in a compression unit, from being introduced into a compression chamber.

It is another object of the present invention to provide a fixed scroll of a scroll compressor which can effectively prevent introduction of heated gaseous refrigerant into a compression chamber via a simple deformation in the shape of the fixed scroll without requiring installation of an additional member.

It is yet another object of the present invention to provide a fixed scroll of a scroll compressor which is enhanced in strength through the use of reinforcing ribs.

In accordance with the present invention, the above and other objects can be accomplished by the provision of a fixed scroll of a scroll compressor comprising: a scroll body provided at a lower surface thereof with an open involuted wrap to define a compression chamber therein; a flange portion formed along an outer circumference of the scroll body; a plurality of mounting legs formed at a lower surface of the flange portion around the wrap to be mounted on an upper surface of a main frame; and an interceptive guiding portion configured to prevent suctioned gaseous refrigerant, directed to the lower surface of the flange portion, from being circulated between the mounting legs underneath the lower surface of the flange portion, and to guide the suctioned gaseous refrigerant to a tip end of the wrap to thereby allow the gaseous refrigerant to be introduced into the compression chamber.

Preferably, the interceptive guiding portion may include a first barrier integrally formed between an outer circumference of the wrap and an inner surface of a first one of the mounting legs at a position facing an entrance of the compression chamber, and a second barrier integrally formed between the outer circumference of the wrap and an inner surface of a second one of the mounting legs at a tip end of the wrap beside the first barrier.

Preferably, reinforcing ribs may be integrally formed between the outer circumference of the wrap and inner surfaces of the remaining mounting legs except for the first and second mounting legs formed with the first and second barriers.

Preferably, the first and second barriers may have the same height as that of the wrap and the mounting legs.

Preferably, the first barrier has a guide recess formed at a gaseous refrigerant path surface thereof facing the entrance of the compression chamber, the guide recess defining a concave arched portion.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
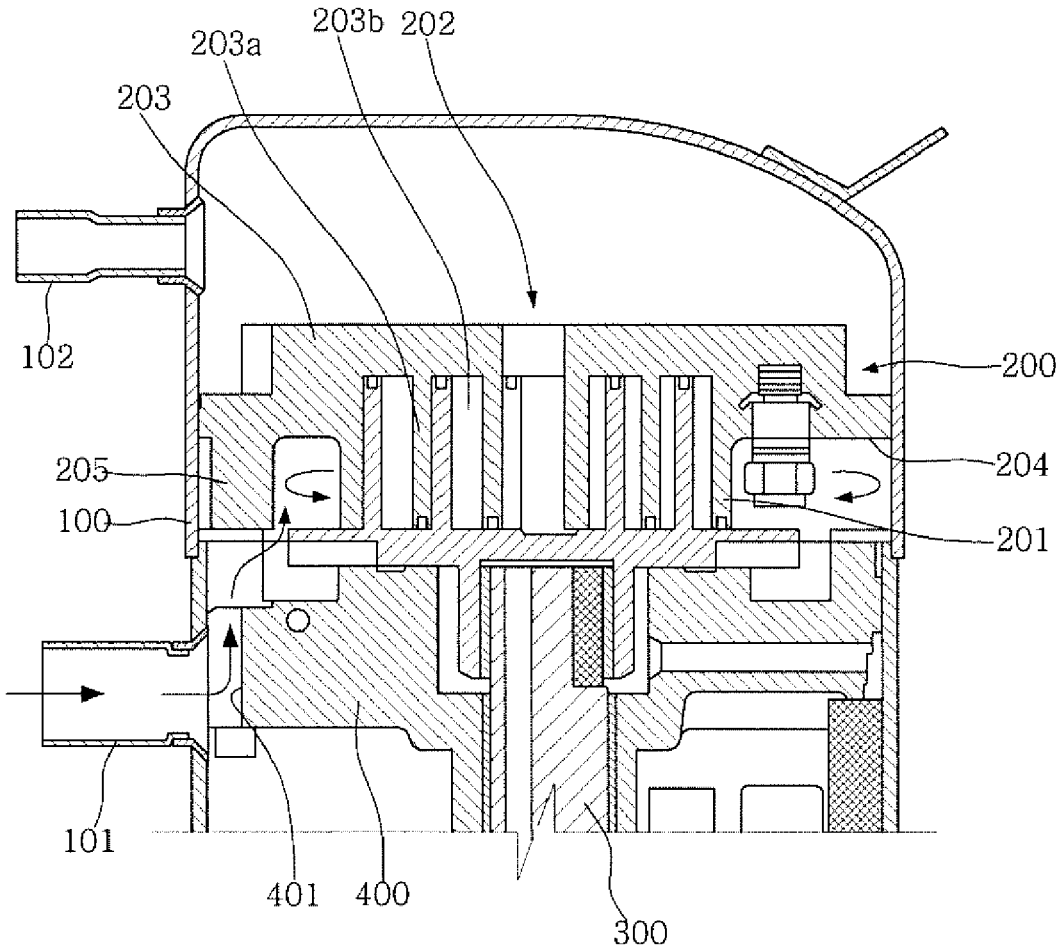
FIG.1 Related Art
FIG. 1 is a longitudinal sectional view illustrating important parts of a conventional scroll compressor.
Figure 2:
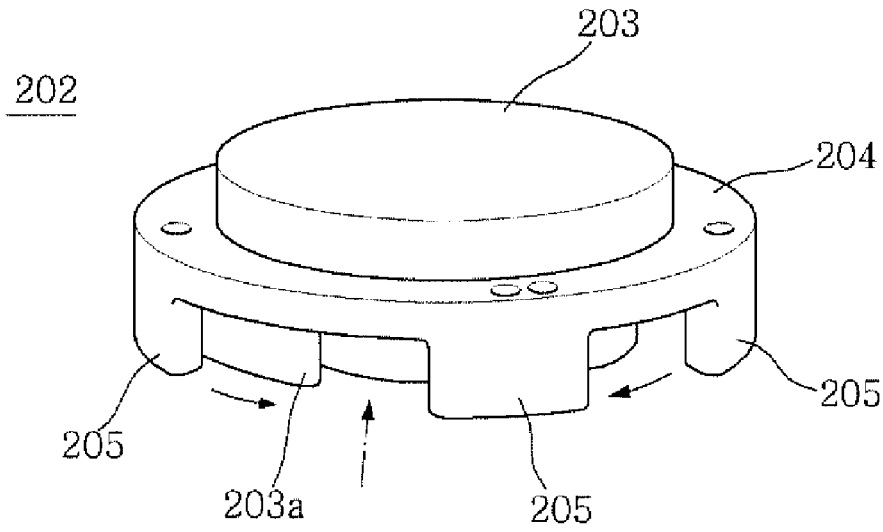
FIG.2 Related Art
FIG. 2 is a perspective view illustrating a fixed scroll of FIG. 1.
Figure 3:
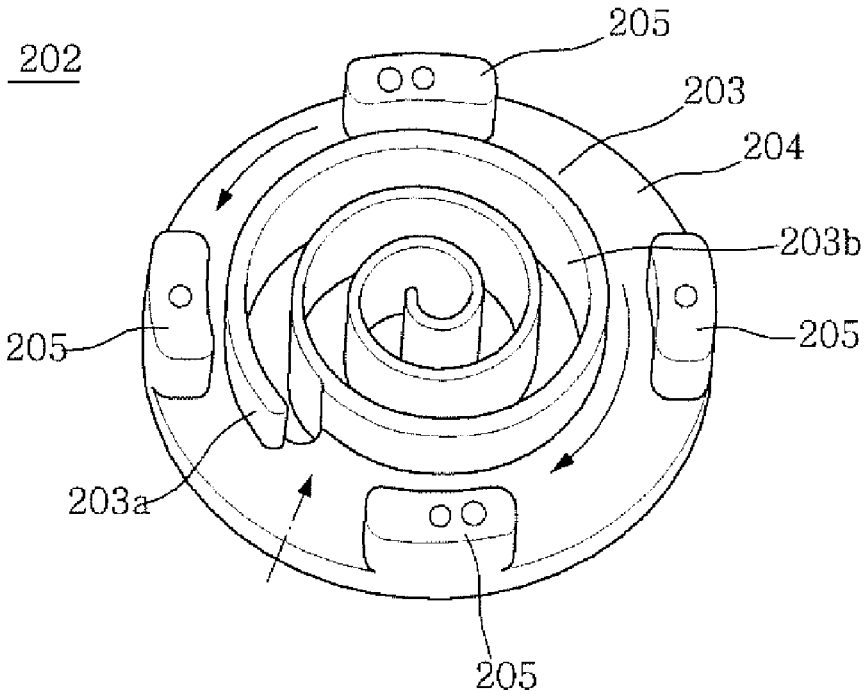
FIG.3 Related Art
FIG. 3 is a bottom perspective view of the fixed scroll of FIG. 2.

Now, preferred embodiments of the present invention will be explained with reference to the accompanying drawings. Where possible, the same reference numerals will be used throughout the drawings to refer to the same or like parts.

Figure 4:
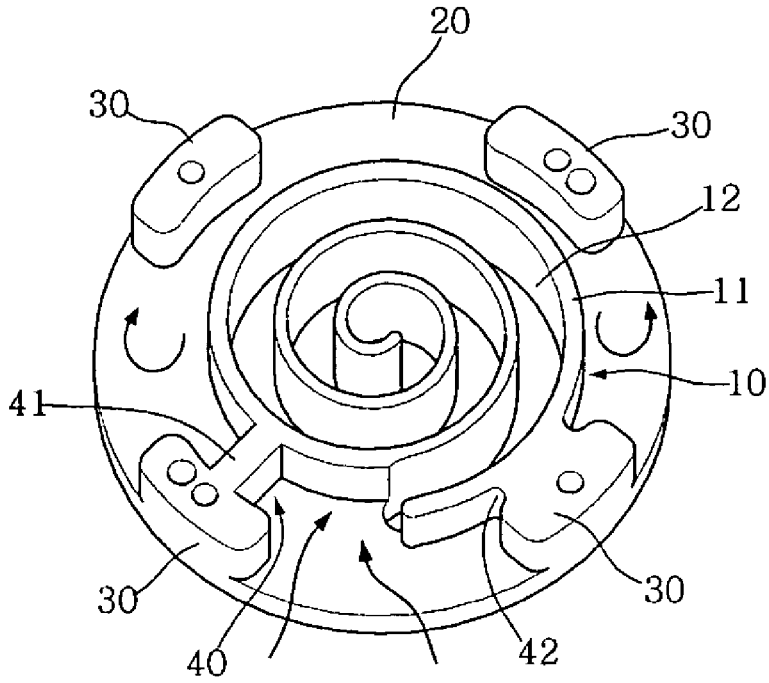
FIG. 4 is a bottom perspective view illustrating a first embodiment of the present invention.

FIG. 4 is a bottom perspective view illustrating a first embodiment of the present invention.

As shown in FIG. 4, a fixed scroll of a scroll compressor includes a scroll body 10 provided at a lower surface thereof with an open involuted wrap 11 to define a compression chamber 12 therein, a flange portion 20 formed along an outer circumference of the scroll body 10, a plurality of mounting legs 30 formed at a lower surface of the flange portion 20 around the wrap 11 to be mounted on an upper surface of a main frame of the compressor, and an interceptive guiding portion 40 formed at the lower surface of the flange portion 20 between the wrap 11 and the mounting legs 30.

The interceptive guiding portion 40 serves to guide suctioned gaseous refrigerant, that is directed to the lower surface of the flange portion 20, to a tip end of the wrap 11 of the scroll body 10 while preventing the refrigerant from being circulated between the mounting legs 30 underneath the lower surface of the flange portion 20, thereby allowing the suctioned gaseous refrigerant to be directly introduced into the compression chamber 12. The interceptive guiding portion 40 includes a first barrier 41 integrally formed between an outer circumference of the wrap 11 and an inner surface of a first one of the mounting legs 30 at a position facing an entrance of the compression chamber 12, and a second barrier 42 integrally formed between the outer circumference of the wrap 11 and an inner surface of a second one of the mounting legs 30 at the tip end of the wrap 11 beside the first barrier 41. Here, the first and second barriers have the same height as that of the wrap 11 and the mounting legs 30.

The first and second barriers 41 and 42 are configured to prevent the gaseous refrigerant, guided to the tip end of the wrap 11 underneath the lower surface of the flange portion 20, from being circulated along the outer circumference of the scroll body 10, thereby allowing the gaseous refrigerant to be smoothly introduced into the compression chamber 12 defined in the wrap 11.

As a result of forming the first and second barriers 41 and 42 at the lower surface of the flange portion 20 between the wrap 10 and the selected ones of the mounting legs 30 located in the vicinity of the tip end of the wrap 11, as stated above, the gaseous refrigerant, guided to the lower surface of the flange portion 20, can be directly introduced into the compression chamber 12 through the tip end of the wrap 11 without being circulated between the mounting legs 30. Also, the first and second barriers 41 and 42 serve to prevent gaseous refrigerant, which is heated in the compressor and is directed to the outer circumference of the scroll body 10, from being introduced into the compression chamber 12.

Preferably, the flange portion 20 is configured to come into close contact, at an outer circumference thereof, with an inner wall surface of a shell to isolate high-pressure and low-pressure gaseous refrigerant in the shell from each other. That is, the flange portion comes into close contact with the inner wall surface of the shell so that it seals upper and lower portions of the shell relative to each other.

When the upper and lower portions of the shell are sealed relative to each other by means of the flange portion 20 formed along the outer circumference of the scroll body 10, there is no need of a high/low pressure separating plate that has been conventionally mounted between the circumference of an upper end of the fixed scroll and the inner wall surface of the shell in order to isolate high-pressure gaseous refrigerant, to be discharged to the upper surface of the fixed scroll, from low-pressure gaseous refrigerant to be introduced into the shell.

Figure 5:
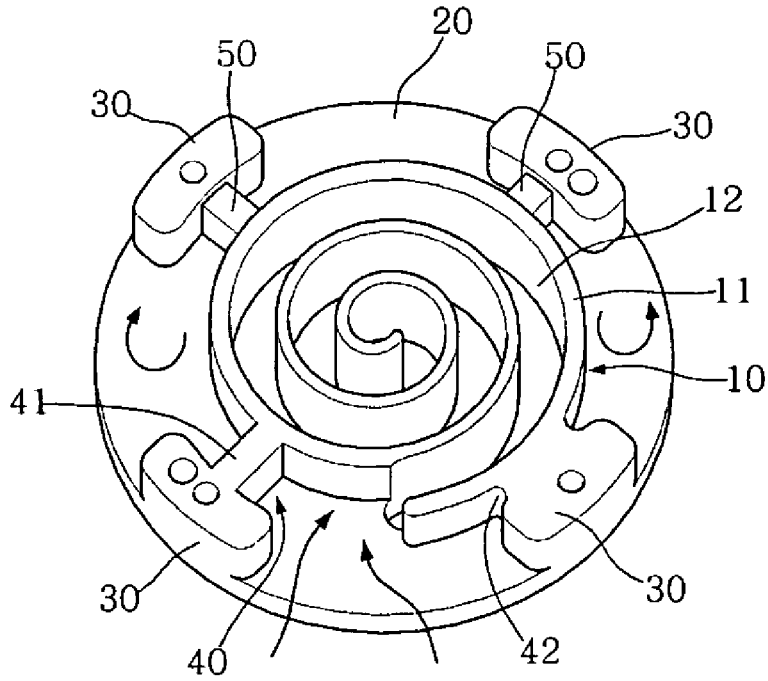
FIG. 5 is a bottom perspective view illustrating a second embodiment of the present invention.

FIG. 5 is a bottom perspective view illustrating a second embodiment of the present invention.

As shown in FIG. 5, the fixed scroll of the scroll compressor includes the scroll body 10 provided at the lower surface thereof with the open involuted wrap 11 to define the compression chamber 12 therein, the flange portion 20 formed along the outer circumference of the scroll body 10 to isolate high-pressure and low-pressure gaseous refrigerant in the shell from each other, the plurality of mounting legs 30 formed at the lower surface of the flange portion 20 around the wrap 11 to be mounted on the upper surface of the main frame, and the interceptive guiding portion 40 formed at the lower surface of the flange portion 20 between the wrap 11 and the mounting legs 30.

The interceptive guiding portion 40 serves to guide suctioned gaseous refrigerant, that is directed to the lower surface of the flange portion 20, to a tip end of the wrap 11 of the scroll body 10 while preventing the refrigerant from being circulated between the mounting legs 30 underneath the lower surface of the flange portion 20, thereby allowing the suctioned gaseous refrigerant to be directly introduced into the compression chamber 12. The interceptive guiding portion 40 includes the first barrier 41 integrally formed between the outer circumference of the wrap 11 and the inner surface of the first one of the mounting legs 30 at a position facing the entrance of the compression chamber 12, and the second barrier 42 integrally formed between the outer circumference of the wrap 11 and the inner surface of the second one of the mounting legs 30 at the tip end of the wrap 11 beside the first barrier 41.

The first and second barriers 41 and 42 are configured to prevent the gaseous refrigerant, guided to the tip end of the wrap 11 underneath the lower surface of the flange portion 20, from being circulated along the outer circumference of the scroll body 10, thereby allowing the gaseous refrigerant to be smoothly introduced into the compression chamber 12 defined in the wrap 11. Here, the first and second barriers have the same height as that of the wrap and the mounting legs.

In the second embodiment of the present invention, reinforcing ribs 50 are integrally formed between the outer circumference of the wrap 11 and inner surfaces of the remaining mounting legs 30 except for the first and second mounting legs formed with the first and second barriers 41 and 42.

The reinforcing ribs 50 serve to effectively and stably connect between the wrap 11 and the mounting legs 30 to thereby increase the overall strength of the fixed scroll.

Figure 6:
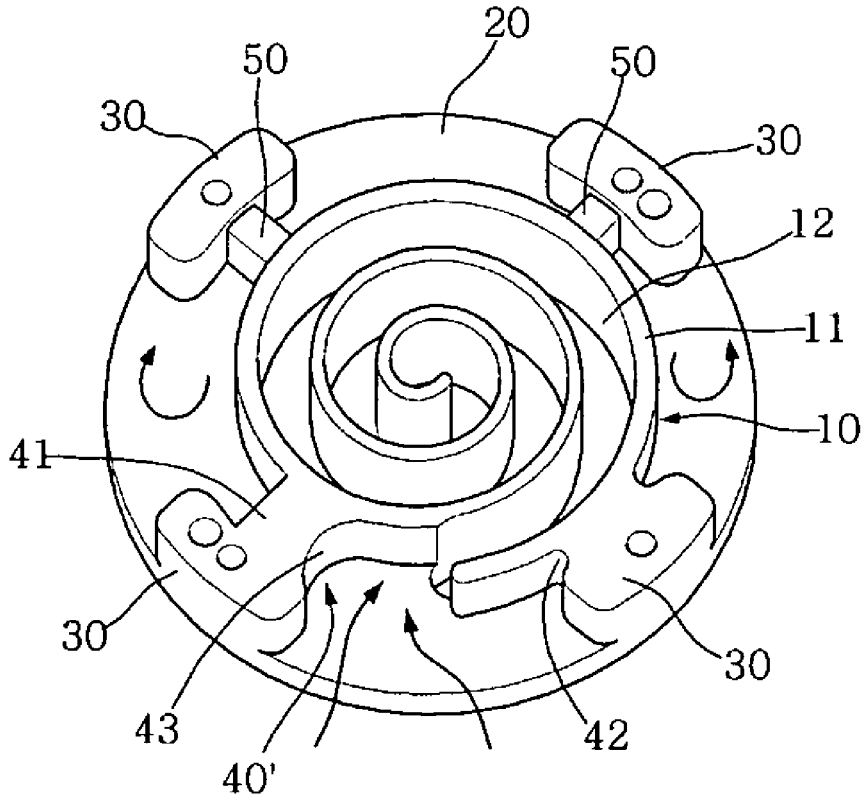
FIG. 6 is a bottom perspective view illustrating a third embodiment of the present invention.

FIG. 6 is a bottom perspective view illustrating a third embodiment of the present invention.

As shown in FIG. 6, the fixed scroll of the scroll compressor includes the scroll body 10 provided at the lower surface thereof with the open involuted wrap 11 to define the compression chamber 12 therein, the flange portion 20 formed along the outer circumference of the scroll body 10 to isolate high-pressure and low-pressure gaseous refrigerant in the shell from each other, the plurality of mounting legs 30 formed at the lower surface of the flange portion 20 around the wrap 11 to be mounted on the upper surface of the main frame, and an interceptive guiding portion 40' formed at the lower surface of the flange portion 20 between the wrap 11 and the mounting legs 30.

The interceptive guiding portion 40' serves to guide suctioned gaseous refrigerant, that is directed to the lower surface of the flange portion 20, to a tip end of the wrap 11 of the scroll body 10 while preventing the refrigerant from being circulated between the mounting legs 30 underneath the lower surface of the flange portion 20, thereby allowing the suctioned gaseous refrigerant to be directly introduced into the compression chamber 12. In accordance with the third embodiment of the present invention, the interceptive guiding portion 40' includes the first barrier 41 integrally formed between the outer circumference of the wrap 11 and the inner surface of the first one of the mounting legs 30 at a position facing the entrance of the compression chamber 12, the second barrier 42 integrally formed between the outer circumference of the wrap 11 and the inner surface of the second one of the mounting legs 30 at the tip end of the wrap 11 beside the first barrier 41, and a guide recess 43 formed at one surface of the first barrier 41 facing the entrance of the compression chamber 12. Here, the first and second barriers have the same height as that of the wrap and the mounting legs.

The guide recess 43 forms a concave arched portion extending from the first mounting leg to the tip end of the compression chamber to smoothly guide the gaseous refrigerant, which is guided to the tip end of the wrap 11 underneath the lower surface of the flange portion 20, into the entrance of the compression chamber 12 defined in the wrap 11.

Similar to the above described second embodiment, the reinforcing ribs 50 are integrally formed between the outer circumference of the wrap 11 and the inner surfaces of the remaining mounting legs 30 except for the first and second mounting legs formed with the first and second barriers 41 and 42.

As apparent from the above description, the present invention provides the following effects.

Firstly, the present invention provides a fixed scroll of a scroll compressor which can prevent gaseous refrigerant, that is heated in the compressor or contains a large amount of oil scattered in a compression unit from being introduced into a compression chamber, thereby enabling more stable introduction of gaseous refrigerant and improving the volumetric efficiency of the compressor to achieve an improved compressor performance. This also prevents excess oil from being introduced into the compression chamber, thereby reducing the amount of oil discharged from the compressor.

Secondly, the fixed scroll of the present invention easily achieves effective introduction of suctioned gaseous refrigerant into the compression chamber while completely preventing introduction of heated gaseous refrigerant via a simple deformation in the shape of the fixed scroll without requiring installation of an additional member. This has the effect of simplifying the manufacturing process of the compressor and reducing manufacturing costs thereof.

Thirdly, according to the present invention, the fixed scroll is provided with reinforcing ribs to achieve an increase in the structural strength of the fixed scroll.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A fixed scroll of a scroll compressor comprising:

a scroll body provided at a lower surface thereof with an open involuted wrap to define a compression chamber therein;

a flange portion formed along an outer circumference of the scroll body;

a plurality of mounting legs formed at a lower surface of the flange portion around the wrap to be mounted on an upper surface of a main frame; and an interceptive guiding portion configured to guide suctioned gaseous refrigerant, directed to the lower surface of the flange portion, to a tip end of the wrap to thereby introduce the gaseous refrigerant into the compression chamber, wherein the interceptive guiding portion includes:

a first barrier integrally formed between an outer circumference of the wrap and an inner surface of a first one of the mounting legs at a position facing an entrance of the compression chamber;

a second barrier integrally formed between the outer circumference of the wrap and an inner surface of a second one of the mounting legs at the tip end of the wrap beside the first barrier; and a curved guide recess formed at one surface of the first barrier and extended from the first mounting leg to the tip end of the compression chamber.

2. The fixed scroll as set forth in claim 1, wherein the first and second barriers have the same height as that of the wrap and the mounting legs.

3. The fixed scroll as set forth in claim 1, wherein reinforcing ribs are integrally formed between the outer circumference of the wrap and inner surfaces of the remaining mounting legs except for the first and second mounting legs formed with the first and second barriers.

4. A scroll compressor comprising:

a sealed shell having a suction pipe and a discharge pipe;

a crankshaft arranged to rotate in the shell by a drive unit;

an orbiting scroll coupled to an upper end of the crankshaft to perform an orbiting motion; and a fixed scroll arranged on an upper surface of a main frame to be engaged with the orbiting scroll so that suctioned gaseous refrigerant is compressed in a compression chamber defined between the engaged scrolls, wherein the fixed scroll includes:

an open involuted wrap provided at a lower surface thereof;

a compression chamber defined in the wrap;

a plurality of mounting legs arranged around the wrap; and an interceptive guiding portion configured to guide gaseous refrigerant, introduced through the suction pipe, to an entrance of the compression chamber, wherein the interceptive guiding portion includes:

a first barrier integrally formed between an outer circumference of the wrap and an inner surface of a first one of the mounting legs at a position facing an entrance of the compression chamber;

a second barrier integrally formed between the outer circumference of the wrap and an inner surface of a second one of the mounting legs at the tip end of the wrap beside the first barrier; and a curved guide recess formed at one surface of the first barrier and extended from the first mounting leg to the tip end of the compression chamber.

5. The scroll compressor as set forth in claim 4, wherein the first and second barriers have the same height as that of the wrap and the mounting legs.

6. The scroll compressor as set forth in claim 4, wherein reinforcing ribs are integrally formed between the outer circumference of the wrap and inner surfaces of the remaining mounting legs except for the first and second mounting legs formed with the first and second barriers.

* * * * *